US006367996B1

(12) United States Patent
Edwards

(10) Patent No.: US 6,367,996 B1
(45) Date of Patent: Apr. 9, 2002

(54) PRINTED IMAGE ALIGNMENT CONTROL

(75) Inventor: Mark Joseph Edwards, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/576,279

(22) Filed: May 23, 2000

(51) Int. Cl.[7] ..... B41J 11/00; B41J 13/26; B41J 13/32

(52) U.S. Cl. ..... 400/582; 400/693; 400/279; 400/578

(58) Field of Search ..... 400/642, 619, 400/633, 633.1, 633.2, 120.17, 279, 61, 578, 582, 693; 347/16, 104

(56) References Cited

U.S. PATENT DOCUMENTS

| | | | | |
|---|---|---|---|---|
| 4,114,750 A | | 9/1978 | Baeck et al. | |
| 4,311,399 A | | 1/1982 | Wegryn et al. | |
| 4,347,001 A | | 8/1982 | Levy et al. | |
| 4,658,366 A | | 4/1987 | Posh | |
| 4,669,900 A | | 6/1987 | Miyake et al. | |
| 4,778,288 A | | 10/1988 | Nakamura | |
| 4,861,175 A | * | 8/1989 | Hori et al. | 400/61 |
| 4,878,063 A | * | 10/1989 | Katerberg | 347/19 |
| 4,974,978 A | | 12/1990 | Tsukamoto | |
| 4,988,221 A | | 1/1991 | Shibayama et al. | |
| 4,990,005 A | | 2/1991 | Karakawa | |
| 5,052,830 A | | 10/1991 | Gohara | |
| 5,052,835 A | | 10/1991 | Takahashi | |
| 5,116,150 A | | 5/1992 | Courtney | |
| 5,250,956 A | | 10/1993 | Haselby et al. | |
| 5,255,987 A | | 10/1993 | Mizuno et al. | |
| 5,288,155 A | | 2/1994 | Suzuki | |
| 5,289,208 A | | 2/1994 | Haselby | |
| 5,409,317 A | | 4/1995 | Ueno et al. | |
| 5,486,055 A | | 1/1996 | Oka | |
| 5,539,863 A | | 7/1996 | Ueda et al. | |
| 5,553,205 A | | 9/1996 | Murray | |
| 5,567,062 A | | 10/1996 | Tanaka et al. | |
| 5,677,999 A | | 10/1997 | Hidaka et al. | |
| 5,699,494 A | | 12/1997 | Colbert et al. | |
| 5,727,135 A | | 3/1998 | Webb et al. | |
| 5,917,511 A | | 6/1999 | Ueda | |
| 5,967,675 A | | 10/1999 | Hastings et al. | |
| 5,971,632 A | | 10/1999 | LaDue et al. | |
| 6,260,945 B1 | * | 7/2001 | Niikura | 347/37 |

FOREIGN PATENT DOCUMENTS

JP 2-45183 A * 2/1990

* cited by examiner

*Primary Examiner*—Daniel J. Colilla
(74) *Attorney, Agent, or Firm*—Lance D. Reich; David S. Kerven

(57) ABSTRACT

A printed image alignment apparatus in a printer that prints a defined portion on a media, the apparatus being an alignment control in connection to the printing device of the printer and which selectively adjusts the alignment of the printed portion on the printed media, and the alignment control being on the exterior surface of the printer. The alignment control is preferably one or more pushbuttons on the exterior surface of the printer that adjust the horizontal and/or vertical alignment of the printed portion on the printed media. The apparatus further preferably includes a reset of default alignment values, and a slow print mode wherein the printing of the media is slowed such that the alignment control selectively adjusts the alignment of the printed portion between printing on individual media and which is reset to regular print speed after a predetermined duration of alignment control inactivity. The invention also includes a method of adjusting the alignment including the steps of aligning the printed portion on the media with the alignment control, and printing on the media to thereby create the printed portion. The method further preferably includes the steps of realigning the printed portion on the media after a first printing on the media, and printing the realigned printed portion on the media.

23 Claims, 5 Drawing Sheets

PRINTED IMAGE ALIGNMENT CONTROL

BACKGROUND OF THE INVENTION

1. Field of the Invention

The present invention generally relates to printers. More particularly, the present invention relates to one or more controls on the exterior surface of the printer for horizontally and vertically aligning a printed image on the printed-upon media.

2. Description of the Related Art

In a typical printer, the pages or other media that is being printed upon is centered in the feed mechanism and a print job with the particular dimensions and parameters of the printing on the media is sent from the host computer. The printer includes some type of printing device that aligns the printing equipment of the printer over the media to print an image with the requested parameters. In several types of printers, such as ink jet printers, the printing device makes a printing swath across the media as it prints lines of text or graphics, and aligns each swath to fall within the printed image. Whenever it is desired to adjust the printed image parameters, a change must be effectuated in the printing equipment and printing device to reposition them in accord with the new desired parameters of the printed image.

Some printers have internal logic, either in hardware or software, that converts the desired printed image parameters to that specific printer's equipment positions and dimensions. Many word-processor and image-editing software products are currently available which provide the capability to the user to allow horizontal and vertical centering of the printed image on the page. However, the alignment of the printed image as set forth in the print job from the host often does not exactly translate on the specific printer to which the host software is sending the print job and precise alignment of the printed image on the media can be problematic.

For instance, when a user desires to match a text edge with a mark on their letterhead, such alignment requires a significant precision printing on the media. Usually, trial and error with software settings is required for a user to achieve this type of precise alignment. With the wide variety of software on a typical host desktop, it is often time-consuming just to learn how to adjust the software settings for the specific image generating the print job in order to get the particular alignment on the printed media. Moreover, the adjustments must occur at the host computer as the print job itself must be modified, and the printed results are only seen at the printer once the media is printed.

There are printers which have physical controls to alter parameters of the printing device in the printer to adjust various qualities of the printed image, however, these control are not readily accessible and often can only be accessed while the printer is not in operation. Therefore, it would be advantageous to provide a simple avenue to adjust the alignment of the printed image on the page at the printer so a user can easily adjust the alignment of the printed image. It is to the provision of such an improved alignment control and method of alignment that the present invention is primarily directed.

SUMMARY OF THE INVENTION

The present invention is a printed image alignment apparatus and a method of aligning a printed image on a printed-upon media, such as pages of paper. The printed image alignment apparatus is in a printer that includes an external surface and a printing device that prints a defined portion on a media. The apparatus comprises an alignment control in connection to the printing device and which selectively adjusts the alignment of the printed portion on the printed media, and the alignment control is on the exterior surface of the printer. This alignment control is preferably used on printers that print upon single pages in sequence, such as ink jet and laser printers.

The alignment control preferably is comprised of one or more pushbuttons on the external surface of the printer that either align the horizontal alignment of the printed portion on the printed media, or align the vertical alignment of the printed portion, or both. The apparatus preferably further includes a slow print mode wherein the printing of the media is slowed such that the alignment control selectively adjusts the alignment of the printed portion between printing on individual pages. The printer then preferably returns to regular print speed from slow print mode after a predetermined duration of alignment control inactivity.

The inventive method of adjusting the alignment of a printed portion of a printed-upon media in a printer with the alignment control on the external surface of the printer includes the steps of aligning the printed portion on the media with the alignment control, and printing on the media to thereby create the printed portion. The method preferably further includes the steps of realigning the printed portion on the media after a first printing on the media, e.g. after one page has printed, and printing the realigned printed portion on the media, e.g. another page.

Accordingly, the step of aligning the printed portion on the media is preferably aligning the printed portion through actuation of one or more pushbuttons that adjust either the horizontal alignment of the printed portion, the vertical alignment, or both. And the method further preferably includes the step of slowing the printing on the media (or completely pausing the printing in between pages) such that the printed portion can be realigned in between different printings, such as between the printing of consecutive pages. The slower printing gives the user of the printer sufficient time to adjust the print swath of the printer to realign the printed portion before the next page is fed and printed.

In a further embodiment, the alignment control can adjust the alignment of the printing device during each consecutive print swath. In operation, the user presses the alignment control for the desired alignment adjustment and the printer automatically initiates the slowed print mode and counts the individual actuations of the alignment control. The printer then stores the number of alignment control actuations between each print swath and adds the cumulative value to the next print swath and the proceeding print swaths thereafter. If the alignment control is actuated during a print job, the printer will immediately go into a slowed print mode where the printing of each swath is slowed. The print swath can then be quickly and iteratively adjusted with the active feedback to the user. Again, once the alignment control has been inactive for a predetermined period, the regular print speed is restored. Thus, the inventive method preferably further includes the steps of realigning the printed portion on the media after printing a first swath on the media, e.g. after one line has printed, and printing the realigned printed portion on the media in a consecutive swath, e.g. another printed line. Any vertical alignments to the individual printed swaths can be made in the same manner during consecutive print swaths.

Further, the printer can include a transparent cover or moveable cover such that the user of the printer can view the printing device as it prints swaths upon the media and the user can make immediate alignment adjustments. Such adjustments are best suited to occur during the slow print mode as discussed above.

The present invention therefore has industrial applicability in that it can either be implemented in the printer during the manufacturing process in hardware or software, or existing printers can be modified to include the alignment controls on their exterior. The alignment control allows the user to quickly realign the print swath such that the printed portion on the media can be adjusted by the user standing at the printer, and not through specific commands directed to the printer from the host. When embodied as one or more pushbuttons, the alignment control allows simple actuation of the one or more pushbuttons to adjust the horizontal or vertical alignments of the printed portion which can be accomplished in consecutive printing of pages or other media, or during consecutive print swaths in a swath printer.

Thus, the present invention provides a commercial advantage to the manufacturer as it gives the printer an advantage over models of competing printers. Other printers must have the print swath either realigned by a command from the host computer, or some physical adjustment to the paper feed or the printer itself must be made to in order to adjust the alignment of the printed portion. Consequently, a simple actuatable control for printed portion alignment represents a distinct improvement over the prior art printers. A user of the invention can quickly, at the output source of the printed media, adjust the printed portion on the media regardless of other application software settings (or lack thereof).

Other objects, features, and advantages of the present invention will become apparent after review of hereinafter set forth in the Brief Description of the Drawings, the Detailed Description of the Invention, and the Claims.

DETAILED DESCRIPTION OF THE INVENTION

Figure 1:
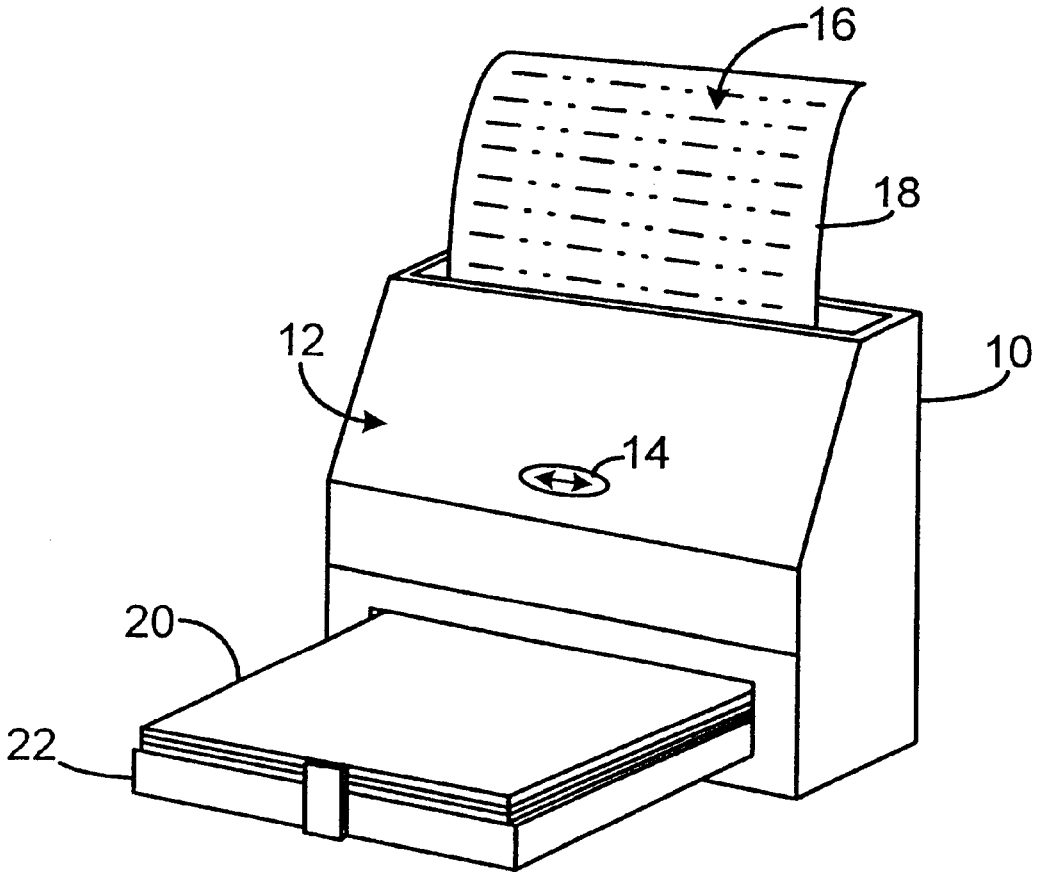
FIG. 1 is a perspective view of a generic printer with the first embodiment of the inventive alignment control on the front exterior surface of the printer.

With reference to the drawings in which like numerals represent like components throughout the several views, FIG. 1 is a perspective view of a generic printer 10 with the first embodiment of the inventive alignment control 14 on the front exterior surface 12 of the printer 10. The printer 10 prints a printed portion 16 on a page 18, or other printed-upon media, that is typically fed through the printer 10, such as from paper supply 20 in paper tray 22. The alignment control 14 is shown here as a single pushbutton that is actuatable in the left and right directions such that the printed portion 16 on page 18 will likewise be adjusted horizontally left or right and the user of the printer 10 can visually adjust the printer portion 16 during consecutive printing of the pages 18 from the paper supply 20.

The printer 10 is shown here in a generic sense, and can be any printer as known in the art, such as an ink jet, laser printer, dot matrix, or the like, all of which include a printing device therein, such as a print carriage and print head as are present in an ink jet printer, or a printing drum as is present in a laser printer. Thus, the alignment control 14 is in electronic connection to the printing device of the printer 10 and selectively adjusts the alignment of the printed portion 16 through whatever printing device and alignment method the particular printing device is using. Such alignment adjustment can be implemented in hardware on the application specific integrated circuit (ASIC) of the printing device, or in software on the printer processor as is further disclosed herein.

Figure 2:
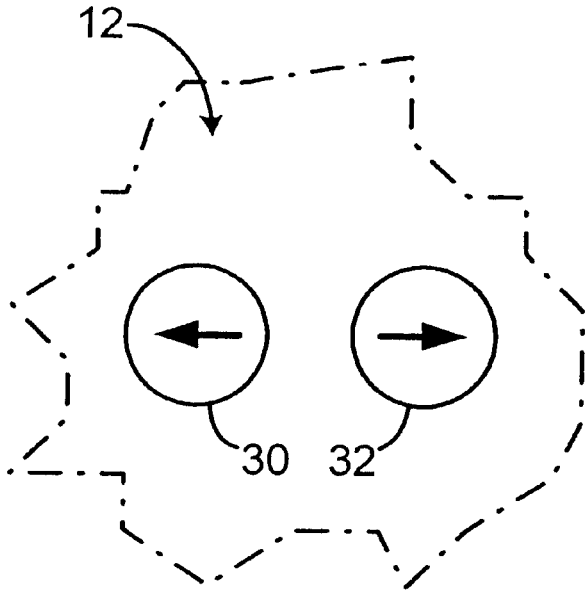
FIG. 2 is a perspective view a second embodiment of the alignment control comprised of a right adjust and left adjust pushbutton.
Figure 3:
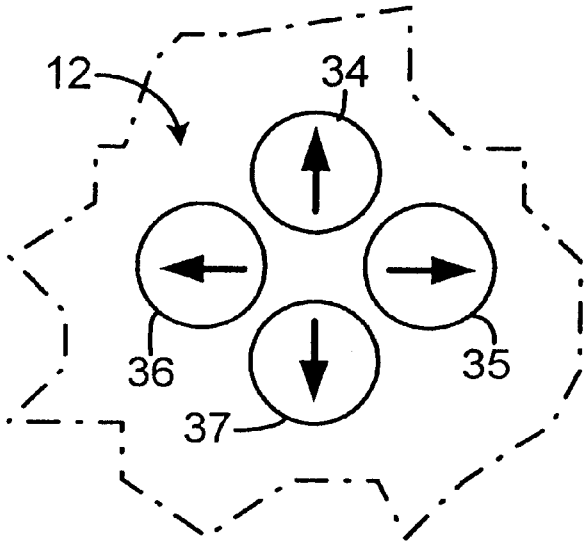
FIG. 3 is a perspective view of a further embodiment of the alignment control illustrating a top adjust and bottom adjust pushbutton for the vertical alignment of the printed portion.

As shown in FIGS. 2 and 3, the alignment control 14 can be alternately embodied as more than one pushbutton on the exterior surface 12 of the printer 10. In FIG. 2, the alignment control is comprised of a left horizontal alignment button 30 and a right horizontal alignment button 32 which each adjust the printed portion 16 on the page 18 when actuated. Furthermore, in FIG. 3, the alignment control is comprised of top vertical alignment button 34, right horizontal alignment button 35, left horizontal alignment button 36 and bottom vertical alignment button 37. In this embodiment, the alignment control allows control at the printer of both the horizontal and vertical alignment of the printed portion 16 of the page 18 or other media. Like the two-pushbutton embodiment of FIG. 2, actuation of each of the four-pushbuttons of the embodiment of FIG. 3 causes an adjustment in the direction indicated by the pushbutton to the printed portion 16 on the media.

Furthermore, while the alignment control 14 is shown herein as a pushbutton, the alignment control 14 can be alternately embodied as any physically actuatable switch, toggle, button, dial, or control as known in the art. The relevant aspect of the alignment control 14 is that it should be simply physically actuatable for the user to adjust the alignment of the printed portion 16 and accessible on or from the exterior 12 of the printer 10.

Figure 4:
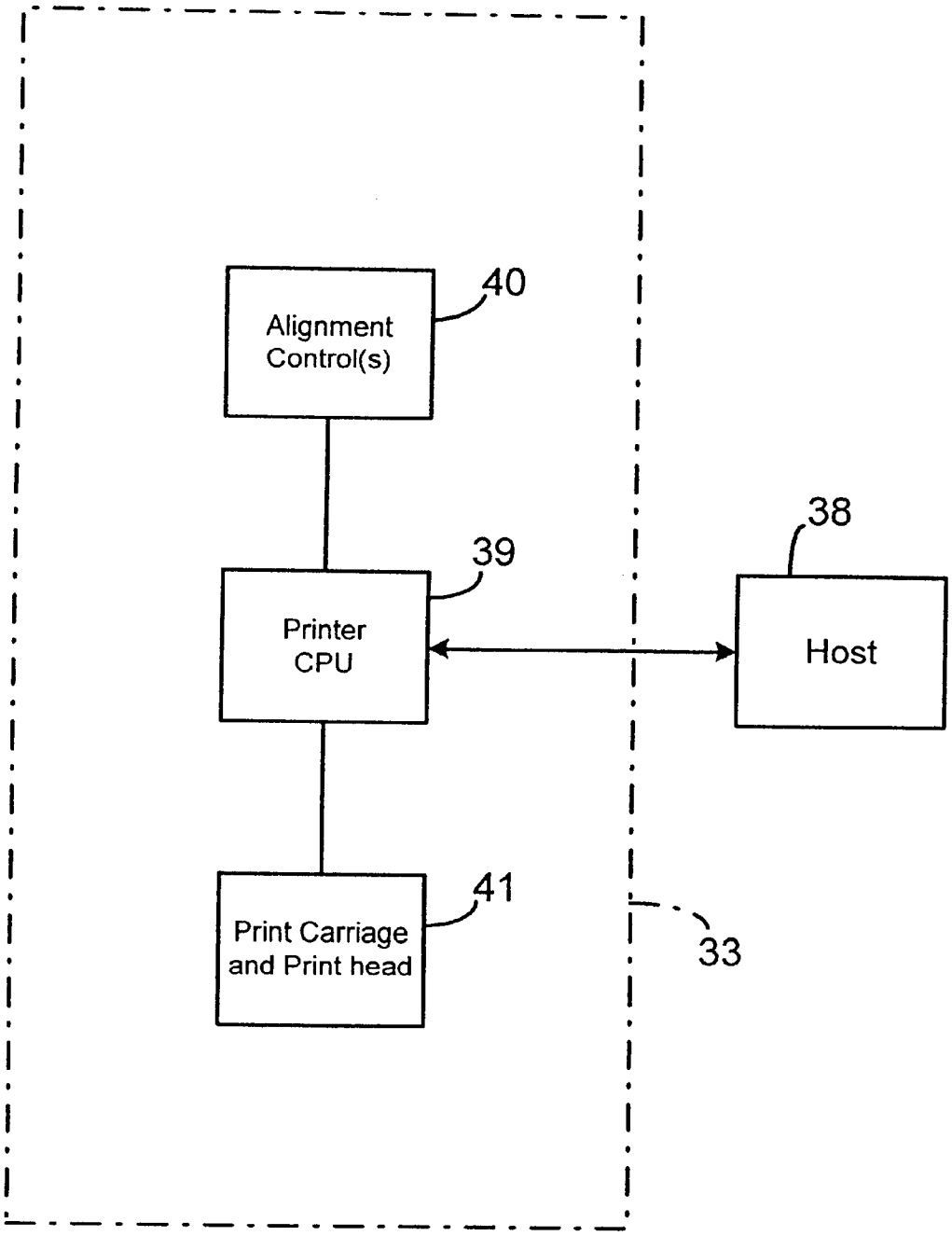
FIG. 4 is a block diagram of the printer components and a host in communication with the printer CPU.
Figure 5:
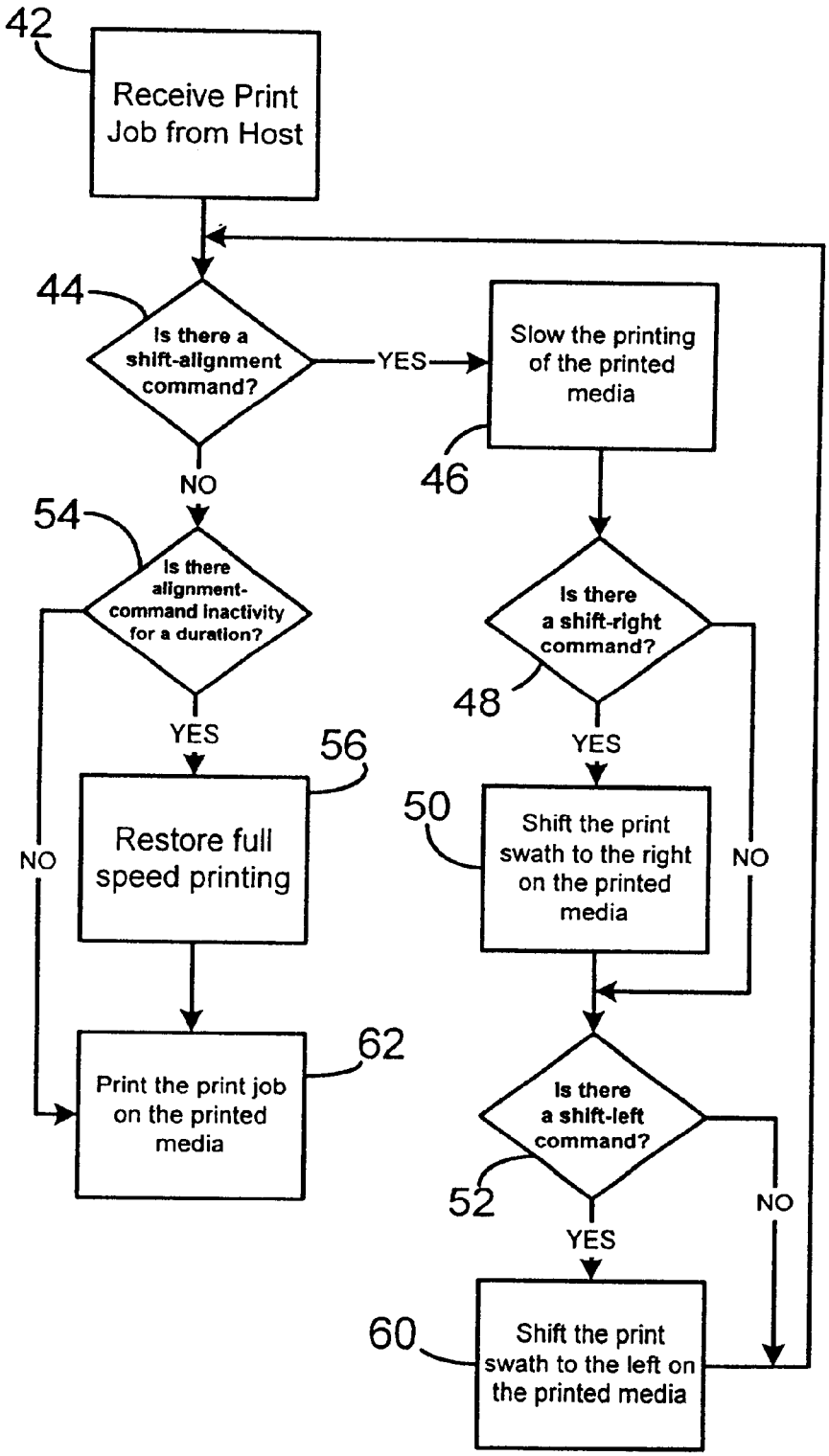
FIG. 5 is a flowchart illustrating the process of adjusting the horizontal alignment of the image to be printed on the printed media in the printer.

With reference to FIG. 4, in a typical connection, the printer 33 is in communication with a host computer 38. The host computer 38 is in communication to the printer processing platform, and generally the printer central processing unit (CPU) 39 such that print jobs and commands can be transferred from the host 38 to the printer CPU 39 for execution, i.e. printing. The printer CPU 39 controls the printing device of the printer, shown here as the print carriage and print head 41 for execution of the specific print job sent from the host 38. The alignment control(s) 40 present on the printer 33 are connected to the printer CPU to adjust the horizontal and vertical alignment of the printed portion 16 of the page 18. The adjustment of the alignment can occur either in the ASIC of the printer CPU, or shifting of the alignment of the entire print job batch in hardware, or can be shifted in software being executed upon the printer CPU 39 while the print job is being processed, as shown in the flowchart of FIG. 5. The printer will retain the adjustment values until reset. The printer CPU 39 contains the default alignment values to which the printer can be reset, if desired. The printer can alternately include a separate button or code to reset the printing values, such as pressing both buttons 30 and 32 at once.

FIG. 5 illustrates the preferred process for printing with the alignment control adjusting the horizontal alignment of the printed portion 16 of the media (page 18) during the print job. The print job is received from the host, shown at step 42, and then a comparison is made to determine if a shift-alignment command is present from the alignment control, shown at comparison 44. If there is a shift-alignment command present then slow-print mode is begun, as shown at step 44, and another comparison is made to determine if it is a shift-right command present, shown at comparison 48. If there is a shift-right command present, then the printer CPU 39 shifts the printer device, such as print carriage and print head 41, to the right on the media being printed upon, shown at step 50. If there is not a shift-right command present, then a further comparison is made to determine if a shift-left command is present, shown at comparison 52, which is also reached once any shift-right command has been executed. If there is a shift-left command present, then the printer CPU 39 shifts the print carriage and print head 41 to the left on the printed-upon media, and then return to the initial shift-alignment determination comparison, or comparison 44. If no shift-left commands are present at comparison 52, then the process likewise returns to comparison 44 to thus form a shift-alignment loop. If the alignment control is embodied with vertical alignment pushbuttons for adjustments as is shown in FIG. 3, then parallel comparisons to 48 and 52 and commands 50 and 60 would be present in the shift-alignment loop for top and bottom alignment adjustments.

The shift-alignment loop allows cumulative adjustment of the alignments to the printed portion 16 of the page 18 during the print job. The loop also allows for countermanding inputs from the alignment control 14 which may occur during visual alignment of the printed portion 16, or error correction in between consecutive printings.

Returning to comparison 44, if no shift-alignment commands are present, then a comparison is made to determine if there has been a predetermined period of shift-alignment command inactivity, i.e. alignment control inactivity, shown at comparison 54. An example of a predetermined duration of inactivity would be 2 page feeds, and the regular print speed is restored at step 56 until further alignment control activation.

If an alignment adjust command is present, then the printing of the media is slowed in the printer 10, shown at step 46, such that alignment adjustments can more easily be made by the user at the printer 10. In a slow-print mode, with reference again to FIG. 1, the printer 10 slowly feeds and prints each sheet of paper 18 from the paper supply 20 through the printer 10 whereby the user can view the printed portion 16 of the page 18 and then timely adjust the alignment of the printed portion on the next printed page from the paper supply 20 based upon the existing printed portion. An example of slowing the print job would be changing the page printing speed from 1 second between page printings to 8 seconds between page printings. Further, the slow-print mode is invoked immediately upon actuation of the alignment control to slow the printing for manipulation of the pushbuttons to change alignments.

The steps related to alignment-command inactivity and slow-print commands are preferred but not necessary in implementation of the present invention. Further, the specific sequence of execution of the steps as disclosed in FIG. 5 can be altered as dictated by user preferences.

Figure 6:
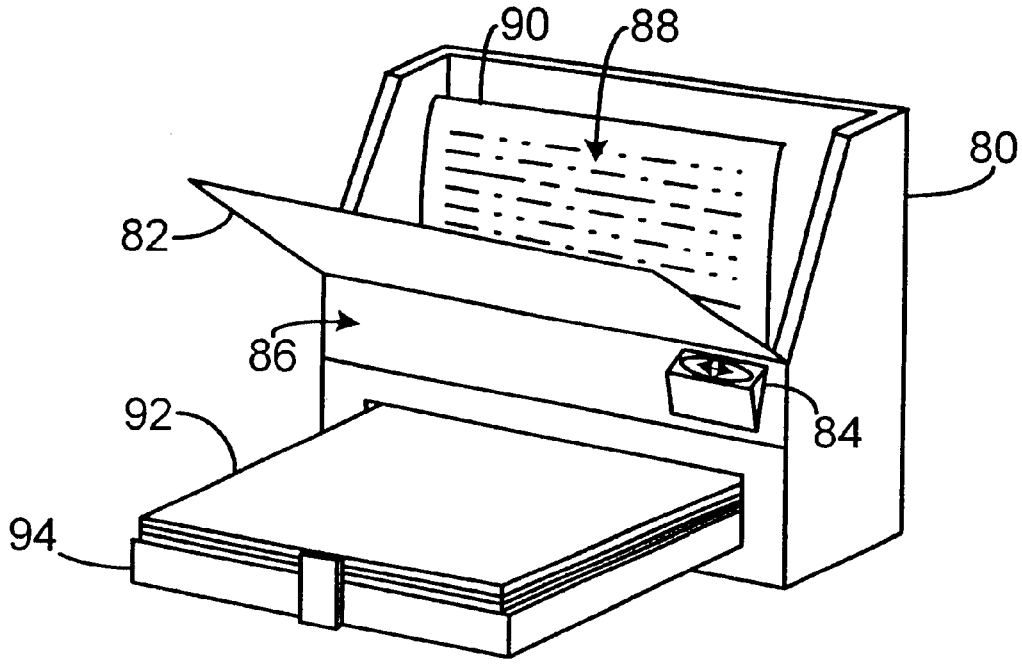
FIG. 6 is an alternate embodiment of the alignment control as raised on the exterior surface of the printer, and the printer includes a cover that can be opened to reveal the printing device printing each swath on the media.

FIG. 6 is a perspective view of an alternate embodiment of the present invention with a swath-type printer, here shown as an ink-jet printer 80, having an access door 82 with a raised alignment control 84 on an exterior surface 86 of the printer 80. The printer 80 prints a printed portion 88 on the page 90, or other printed-upon media, that is fed through the printer 80 from paper supply 92 in paper tray 94. The alignment control 84 is shown as a single pushbutton and is raised for easy access by the user. The user of the printer 80 can open the access door 82 and visually adjust the alignment of the printed portion 88 during each individual printing swath of the printing device, such as a print carriage and print head as is present in an ink jet or dot matrix printer. The particular process for aligning the printed portion 88 is preferably the same as detailed in FIG. 5.

Accordingly, as shown in FIGS. 1 and 5, it can be seen that the present invention provides a method of adjusting the alignment of a printed portion 16 of a printed-upon media, such as page 18, in a printer 10 with an alignment control 14 on the external surface 12 of the printer 10. The method includes the steps of aligning the printed portion 16 on the media with the alignment control 14, and printing on the media thereby creating the printed portion 16. The method preferably further includes the steps of realigning the printed portion 16 on the media (page 18) after a first printing on the media, and printing the realigned printed portion on the media.

As shown above, the step of aligning the printed portion 16 on the media is aligning the printed portion 16 through actuation of one or more pushbuttons (FIGS. 1–3). Thus, the step of aligning the printed portion can be adjusting either the vertical or horizontal alignment of the printed portion 16. Furthermore, the method can include the step of slowing the printing on the media such that the user can make alignments during consecutive printing without needing to alter the print job itself.

While there has been shown a preferred and alternate embodiments of the present invention, it is to be understood that certain changes may be made in the form and arrangement of the components and in the sequence of the steps without departing from the underlying spirit and scope of the invention as set forth in the Claims. Furthermore, all means-plus-function elements in the claims are intended to encompass all equivalent structures to those disclosed herein as would be known to one of skill in the art.

What is claimed is:

1. A printed image alignment apparatus in a printer including an exterior surface and a printing device that prints a defined printed portion on a media, the apparatus comprising an actuatable alignment control communicatively coupled with the printing device and on the exterior surface of the printer, wherein the alignment control, upon actuation, slows the printing device's speed to facilitate alignment adjustment and selectively adjusts the alignment of the printed portion on the printed media based upon actuation.

2. The apparatus of claim 1, wherein the alignment control is a pushbutton on the exterior surface of the printer.

3. The apparatus of claim 1, wherein the alignment control aligns the horizontal alignment of the printed portion on the printed media.

4. The apparatus of claim 1, wherein the alignment control aligns the vertical alignment of the printed portion of the printed media.

5. The apparatus of claim 1, wherein the alignment control is a plurality of pushbuttons on the exterior surface of the printer.

6. The apparatus of claim 1, wherein the alignment control further automatically resets the print device's print speed to normal after a predetermined duration of alignment control inactivity.

7. The apparatus of claim 1, wherein the printing device prints the printed portion on the media in printing swaths, and the alignment control selectively adjusts the printed portion on the media during each swath of the printing device.

8. The apparatus of claim 1, wherein the alignment control further automatically resets the print device's alignment values to default alignment values after a predetermined duration of alignment control inactivity.

9. A printed image alignment apparatus in a printer including an exterior surface and a printing means for printing a defined printed portion on a media, the apparatus comprising an alignment means communicatively coupled with the printing means and on the exterior surface of the printer, the alignment means for slowing the printing mean's speed to facilitate alignment adjustment and for selectively adjusting the alignment of the printed portion on the printed media.

10. The apparatus of claim 9, wherein the alignment means is a pushbutton on the exterior surface of the printer.

11. The apparatus of claim 9, wherein the alignment means aligns the horizontal alignment of the printed portion on the printed media.

12. The apparatus of claim 9, wherein the alignment means aligns the vertical alignment of the printed portion of the printed media.

13. The apparatus of claim 9, further include a reset means for reseting the printing means to default alignment values after a predetermined duration of alignment means inactivity.

14. The apparatus of claim 9, wherein the alignment means is a plurality of pushbuttons on the exterior surface of the printer.

15. The apparatus of claim 9, wherein the printing means prints the printed portion on the media in printing swaths, and the alignment means selectively adjusts the printed portion on the media during each swath of the printing means.

16. The apparatus of claim 9, wherein the alignment control further comprises a reset means for resetting the print device's print speed to normal after a predetermined duration of alignment means inactivity.

17. A method of adjusting the alignment of a printed portion of a printed-upon media in a printer with an actuatable alignment control on the exterior surface of the printer, the method comprising the steps of:

in response to action of the alignment control, slowing the printing on the printed-upon media to facilitate alignment adjustment;

aligning the printed portion on the media based upon actuation of the alignment control; and printing on the media thereby creating a first printing of the printed portion.

18. The method of claim 17, further comprising the steps of:

realigning the printed portion on the media after the first printing on the media; and printing the realigned printed portion on the media.

19. The method of claim 18, wherein the printer prints upon the printed portion in swaths, and further comprising the steps of: realigning the printed portion on the media after printing a first swath on the media; and printing the realigned printed portion on the media in a second swath.

20. The method of claim 17, wherein the step of aligning the printed portion is adjusting the horizontal alignment of the printed portion.

21. The method of claim 17, wherein the step of aligning the printed portion is adjusting the vertical alignment of the printed portion.

22. The method of claim 17, and further comprising the step of resetting the print device's print speed to normal after a predetermined duration of alignment control actuation inactivity.

23. The method of claim 17, and further comprising the step of resetting the print device's alignment values to default alignment values after a predetermined duration of alignment control actuation inactivity.

* * * * *